US008215093B2

(12) United States Patent
Ohshima et al.

(10) Patent No.: US 8,215,093 B2
(45) Date of Patent: Jul. 10, 2012

(54) SLIVER FOR SPINNING, METHOD FOR PRODUCING THE SAME, AND SPUN YARN AND FIBER PRODUCT USING THE SAME

(75) Inventors: Kunihiro Ohshima, Neyagawa (JP); Susumu Katsuen, Osaka (JP); Ippei Yamauchi, Osaka (JP); Masahide Shinohara, Osaka (JP)

(73) Assignee: Kurashiki Boseki Kabushiki Kaisha, Okayama (JP)

( * ) Notice: Subject to any disclaimer, the term of this patent is extended or adjusted under 35 U.S.C. 154(b) by 0 days.

(21) Appl. No.: 12/997,207

(22) PCT Filed: Aug. 7, 2009

(86) PCT No.: PCT/JP2009/064016

§ 371 (c)(1),
(2), (4) Date: Dec. 9, 2010

(87) PCT Pub. No.: WO2010/018792

PCT Pub. Date: Feb. 18, 2010

(65) Prior Publication Data

US 2011/0078993 A1 Apr. 7, 2011

(30) Foreign Application Priority Data

Aug. 11, 2008 (JP) ..... 2008-207179

(51) Int. Cl.
*D02G 3/02* (2006.01)

(52) U.S. Cl. ..... 57/252

(58) Field of Classification Search ..... 57/252, 57/255, 256, 257, 258

See application file for complete search history.

(56) References Cited

U.S. PATENT DOCUMENTS

| | | | | |
|---|---|---|---|---|
| 4,146,417 | A * | 3/1979 | Drelich et al. | 156/62.2 |
| 4,540,454 | A * | 9/1985 | Pieniak et al. | 156/62.2 |
| 5,292,822 | A | 3/1994 | Tanaka et al. | |
| 6,610,174 | B2 * | 8/2003 | Sun et al. | 162/158 |
| 7,291,389 | B1 * | 11/2007 | Bitler et al. | 428/373 |
| 2008/0040906 | A1 * | 2/2008 | Earley et al. | 28/144 |

FOREIGN PATENT DOCUMENTS

| | | |
|---|---|---|
| JP | 5-132858 | 5/1993 |
| JP | 6-200479 | 7/1994 |
| JP | 2002-332321 | 11/2002 |
| JP | 2002-339187 | 11/2002 |
| JP | 2003-89971 | 3/2003 |
| JP | 2006-241615 | 9/2006 |

* cited by examiner

*Primary Examiner* — Shaun R Hurley
(74) *Attorney, Agent, or Firm* — Hamre, Schumann, Mueller & Larson, P.C.

(57) ABSTRACT

A sliver for spinning having a deodorizing and/or heat-generating moisture absorption function is provided, where a sliver for spinning formed as a bundle, in which staple fibers are aligned in one direction, is irradiated with an electron beam to provide an activating group and/or produce a radical on a surface of the fibers, and a compound including an ethylenic unsaturated double bond is chemically bonded to the surface of the fibers. A spun yarn of the invention is a spun yarn having a deodorizing and/or heat-generating moisture absorption function, including the above-described sliver for spinning that has been spun, or including the above-described sliver for spinning and a sliver other than the sliver for spinning that have been blended and spun. A fiber product of the invention has a deodorizing and/or heat-generating moisture absorption function, including the above-described spun yarn.

12 Claims, 2 Drawing Sheets

SLIVER FOR SPINNING, METHOD FOR PRODUCING THE SAME, AND SPUN YARN AND FIBER PRODUCT USING THE SAME

TECHNICAL FIELD

The present invention relates to a sliver having a deodorizing function and/or a heat-generating moisture absorption function, a method for producing the same, and spun yarn and a fiber product using the same.

BACKGROUND ART

The heat-generating moisture absorption property refers to a property by which dry fibers generate heat when absorbing moisture (water). For example, a futon that has been exposed to the sunlight during the daytime, and then has been taken into a room will have the same temperature as the room temperature after the passing of several hours. However, when such futon is brought into contact with human skin, the person feels that the futon is warm. This phenomenon is known to be attributed to the heat-generating moisture absorption property possessed by the fibers of the futon.

As conventional methods for producing a heat-generating, moisture-absorbing fiber, high moisture absorbing and desorbing fibers obtained by a hydrazine cross-linking treatment of an acrylic fiber, a hydrolysis treatment, and the conversion of a carboxyl group to a salt form, and production methods thereof have been proposed in Patent document 1 and Patent document 2.

However, these proposals relate to the modification of an acrylic fiber itself and, thus, were difficult to apply to other fibers.

The present inventors have already proposed methods in which a different material is graft polymerized to the surface of a fiber using radiation, thereby performing an antimicrobial treatment or the like (Patent document 3 and Patent document 4).

However, there has been room for a further improvement in obtaining a sliver and a spun yarn that are imparted with a deodorizing function and/or a heat-generating moisture absorption function, and a fiber product using them.

PRIOR ART DOCUMENT

Patent Document

Patent document 1: JP H05-132858A
Patent document 2:JP 2003-089971A
Patent document 3:JP 2002-339187A
Patent document 4:JP 2006-241615A

DISCLOSURE OF INVENTION

Problem to be Solved by the Invention

In order to solve the foregoing problems, the present invention provides a sliver having a deodorizing function and/or a heat-generating moisture absorption function, a method for producing the sliver in an efficient and rational manner, and a spun yarn and a fiber product using the sliver.

Means for Solving Problem

A sliver for spinning according to the present invention is a sliver for spinning having a deodorizing function and/or a heat-generating moisture absorption function, wherein a sliver for spinning formed as a bundle in which staple fibers are aligned in one direction is irradiated with an electron beam to provide an activating group and/or produce a radical on a surface of the fibers, and a compound including an ethylenic unsaturated double bond is chemically bonded to the surface of the fibers.

A method according to the present invention is a method for producing a sliver for spinning having a deodorizing function and/or a heat-generating moisture absorption function, including: irradiating a sliver for spinning formed as a bundle in which staple fibers are aligned in one direction with an electron beam under a nitrogen atmosphere to provide an activating group and/or produce a radical on a surface of the fibers, and immediately thereafter, continuously bringing a compound including an ethylenic unsaturated double bond into contact with the surface of the fibers to form a chemical bond, thereby imparting the sliver for spinning with a deodorizing function and/or a heat-generating moisture absorption function.

A spun yarn according to the present invention is a spun yarn having a deodorizing function and/or a heat-generating moisture absorption function, including the above-described sliver for spinning and a sliver other than the sliver for spinning that have been blended and spun.

A fiber product according to the present invention is a fiber product having a deodorizing function and/or a heat-generating moisture absorption function, including the above-described spun yarn.

Effects of the Invention

According to the present invention, a sliver for spinning formed as a continuous bundle in which staple fibers are aligned in one direction is irradiated with an electron beam to provide an activating group and/or produce a radical on a surface of the fibers, and a compound including an ethylenic unsaturated double bond is chemically bonded to the surface of the fibers. Thereby, a deodorizing function and/or a heat-generating moisture absorption function can be imparted uniformly to the entire sliver for spinning. That is, the sliver for spinning has a low density, and therefore, an electron beam can be uniformly applied to the sliver for spinning. In addition, the use of a sliver that is formed as a continuous bundle enables continuous processing of the sliver. Furthermore, the use of a sliver for spinning also makes it possible, for example, to mix the constituent fibers with each other, or to blend a processed fiber and an unprocessed fiber in a subsequent step. In other words, it is possible to disperse processed fibers uniformly. Furthermore, a compound containing an ethylenic unsaturated double bond having a relatively high concentration can be chemically bonded to a processed fiber in advance, and the processed fiber can be blended with an unprocessed fiber in a subsequent step.

DESCRIPTION OF THE INVENTION

Figure 1:
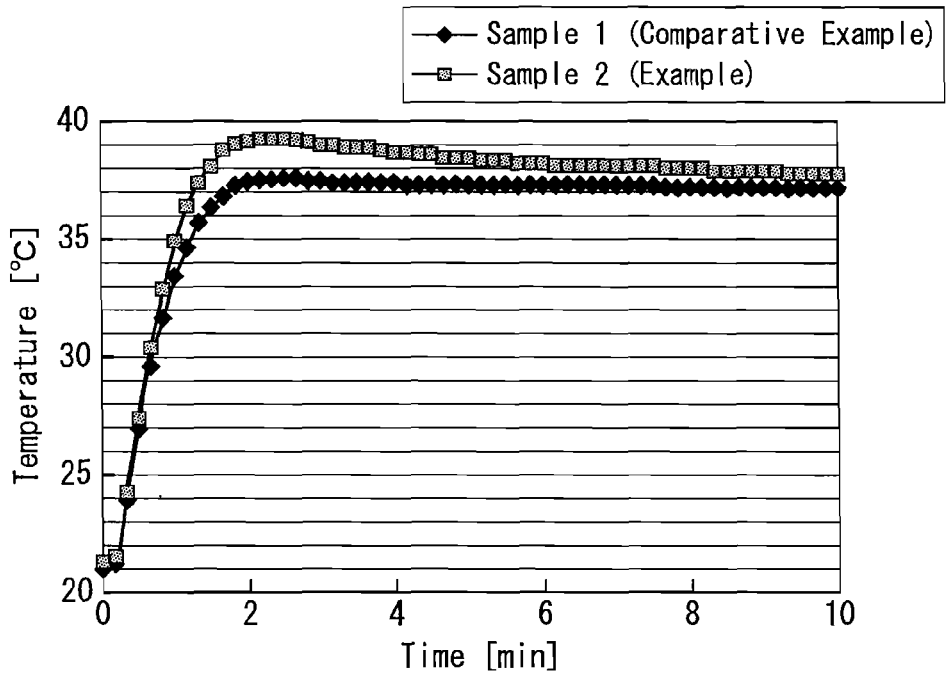
FIG. 1 is a graph showing the heat-generating moisture absorption properties of a fabric according to an example of the present invention.

Hereinafter, the present invention will be described by way of illustrative embodiments with reference to the drawings.

1. Outline of Cotton Spinning Process

The following describes the outline of a cotton spinning process.

(1) Blowing and Scutching Step

Bales of raw cotton are opened, and flocks of raw cotton having different properties respectively are compounded and blended uniformly. More specifically, raw cotton is subjected to the steps of opening, dust removal, and scutching, thereby removing foreign matter contained in the raw cotton while performing cotton blending.

(2) Carding Step

Fibers are passed between needles to remove any foreign matter remaining in the raw cotton while being subjected to carding action, and the fibers are aligned in a parallel manner, thereby forming a carded sliver.

(3) Pre-Combing Step

Carded slivers are placed on top of one another and drawn out, and the fibers are aligned in a parallel manner more precisely. Placing slivers on top of one another is also called "doubling". The number of doublings may be approximately 200 times, for example.

(4) Combing Step

Any short fiber, nep, or the like that could not be removed by the carding step are removed from the carded sliver while exerting a combing action thereon using needles, thereby forming a fiber combed sliver that is proportioned and parallel and placed on top of one another.

(5) Drawing Step

Carded or combed slivers are also placed on top of one another to form a sliver that is proportioned. The number of doublings may be 64 to 216 times, for example. The sliver is drawn out so that the fibers are aligned in a parallel manner to form a drawn sliver that is free of fiber shrinkage.

(6) Roving Step

A drawn sliver is drawn out to a predetermined thickness, then is imparted with a light twist, and wound around a bobbin that is easy to handle.

(7) Spinning Step

The roving is further drawn out to a predetermined thickness, then is imparted with a proper twist, and is wound around a bobbin.

In the present invention, it is possible to use a sliver that has undergone the steps up to any step from the carding step (2) above to the drawing step (5) above. Preferably, a sliver that has undergone the steps up to the combing step (4) is used.

A sliver according to the present invention is advantageous in that it has a low density (approximately 0.004 to 0.15 g/cm$^3$), can be irradiated with an electron beam in a uniform manner, and can be processed continuously. The sliver is advantageous also in terms of its form, since it is possible to mix the constituent fibers or to blend a processed fiber and an unprocessed fiber in a subsequent step. Although it is conceivable to use a thread-like material, a cotton bulk material, or a fabric in place of a sliver, it is not practical to use a thread-like material since it is difficult to penetrate therethrough with an electron beam. Although a permeable radiation such as a γ ray (radiation) can penetrate a thread-like material, it is not preferable to use a thread-like material in the case of using an electron beam. For a cotton bulk material, the process is performed in a so-called "batch" style; therefore, the processing efficiency is significantly reduced. The use of raw cotton itself is not suitable for an electron beam application because of obstruction by foreign matter contained in the raw cotton. Furthermore, it is not preferable to use a fabric, since all fibers are irradiated with an electron beam and, thus, the fibers cannot be mixed with each other at a later time.

The thickness of the sliver is preferably 3.2 g/6 yd to 97.2 g/6 yd (50 grains/6 yd to 1500 grains/6 yd), more preferably in the range of 5 g/6 yd to 35 g/6 yd (80 grains/6 yd to 550 grains/6 yd). Here, 1 g is equivalent to 15.432 grains, 1 pound (453.59 g) is equivalent to 7000 grains, and 1 yd is equivalent to 0.9144 m.

While the irradiation amount of an electron beam varies depending on the mass, numbers, raw material, etc. of the sliver, an example of the preferable range is 1 to 200 kGy.

According to the present invention, the compound including an ethylenic unsaturated double bond is for example, a compound having one ethylenic unsaturated double bond and one or two carboxyl groups, and preferably at least one carboxylic acid selected from the group consisting of acrylic acid, methacrylic acid, itaconic acid, maleic acid and fumaric acid, or an ester or salt thereof. By chemically bonding each of these compounds to the surface of the fibers, a deodorizing function and/or a heat-generating moisture absorption function that are endurable to washing can be imparted to the fiber. The chemical bond is formed by various reactions such as a reaction in which an activating group (e.g., —OH, —$NH_2$, >NH) is provided and/or a radical is produced on the surface of the fibers by electron beam irradiation, a reaction in which the above-mentioned radical cleaves the ethylenic unsaturated double bond to form a graft bond to the surface of the fibers, a reaction in which the above-mentioned activating group reacts with a carboxylic acid group (—COOH) to form a covalent bond. In particular, the above-described chemical bond is formed mainly by the reaction in which a graft bond is formed.

In a sliver for spinning according to the present invention, the compound including an ethylenic unsaturated double bond is provided to the staple fibers preferably in the range of 1 to 30 mass %, more preferably in the rage of 5 to 20 mass %. Within the above-mentioned ranges, a sliver for spinning according to the present invention can exert a deodorizing function and/or a heat-generating moisture absorption function even if it is blended with an unprocessed fiber.

The staple fibers are preferably at least one fiber selected from the group consisting of cotton, regenerated cellulose (rayon, polynosic, lyocell (manufactured by Lenzing, product name "Tencel"), modal (manufactured by Lenzing, product name "Lenzing modal"), cupro (manufactured by Asahi Kasei Corporation, product name "Bemberg")), cellulose acetate, ramie, kenaf, wool, silk, nylon, acrylic fiber, polylactic fiber, acetate fiber, and ethylene vinyl alcohol (manufactured by KURARAY CO., LTD, product name "Sophista"). The reason is that an activating group can be provided and/or a radical can be produced on the surface of these fibers when they are irradiated with an electron beam. The fiber length of the staple fibers is preferably in the range of 15 to 200 mm.

In the present invention, the term "deodorizing" means to neutralizing or adsorbing the substance causing odor. The examples of the substance causing odor are nitrogen-containing compounds, aliphatic acids, and the like. The examples of the nitrogen-containing compounds are ammonia, trimethylamine, and the like, and the examples of the aliphatic acids are acetic acid, isovaleric acid, and the like. The condition that the substance is neutralized or adsorbed is intended to mean the condition that reduction rate of the concentration of substance causing odor after neutralization or adsorption against the concentration of the substance without neutralization or adsorption is for example 70% or more, preferably 80% or more, more preferably 90% or more.

In the present invention, the term "heat-generating moisture absorption function" means the character that is to generate the heat, for example hydration heat by adsorption of moisture.

In a method according to the present invention, a sliver for spinning is irradiated with an electron beam under a nitrogen atmosphere to provide an activating group and/or produce a radical on a surface of the fibers, and immediately thereafter, a compound including an ethylenic unsaturated double bond is continuously brought into contact with the surface of the fibers. The reason that the compound including an ethylenic unsaturated double bond is brought into contact with the surface of the fiber immediately after the electron beam irradiation is to prevent attenuation of the radical produced by the electron beam irradiation. Since a radical is highly likely to attenuate with time, it is most preferable for the compound including an ethylenic unsaturated double bond to be brought in to contact with the surface of the fibers immediately after electron beam irradiation. The range intended to mean by the term "immediately after electron beam irradiation" is for example the range from a point of the start of the irradiation to a point that all radicals attenuate, preferably the range from a point of the finish of the irradiation to a point that about a half of radicals attenuate. It is also preferable for the compound including an ethylenic unsaturated double bond to be brought continuously into contact with the surface of the fibers immediately after the electron beam irradiation, since this allows the compound including an ethylenic unsaturated double bond to be brought into contact with the radical produced on the surface of the fibers efficiently. Also, this continuous process is advantageous for processing a long sliver for spinning. The term "continuously" is intended to mean "after the electron beam irradiation without any other steps". Furthermore, it is preferable to perform electron beam irradiation under a nitrogen atmosphere, since this makes it easy to provide an activating group and/or produce a radical on the surface of the fibers.

The compound including an ethylenic unsaturated double bond may be brought into contact with the surface of the fibers by a dip method, a spray method, or any other method. For example, it is preferable to prepare the compound including an ethylenic unsaturated double bond in the form of an aqueous solution, and to dip the sliver therein, or spray the solution to the sliver to provide the compound to the sliver.

According to the present invention, the processed sliver for spinning and an unprocessed sliver other than the processed sliver for spinning are blended and spun, thereby obtaining a spun yarn having a deodorizing function and/or a heat-generating moisture absorption function. Ordinarily, it is preferable to perform blending in the drawing step that includes a doubling step. However, blending also can be performed in the roving step or the spinning step by aligning a plurality of slivers, fleece yarns, or roved yarns and drawing them out with a predetermined ratio. In the roving step or the spinning step, blending can be performed through migration of the constituent fibers during twisting. The raw material of the unprocessed sliver is preferably at least one fiber selected from the group consisting of cotton, regenerated cellulose (rayon, polynosic, lyocell (manufactured by Lenzing, product name "Tencel"), modal (manufactured by Lenzing, product name "Lenzing Modal"), cupro (manufactured by Asahi Kasei Corporation, product name "Bemberg")), cellulose acetate fiber, ramie, kenaf, wool, silk, nylon, polyester, acrylic fiber, polylactic fiber, acetate fiber, and ethylene vinyl alcohol (manufactured by KURARAY CO., LTD, product name "Sophista").

According to the present invention, examples of a fiber product having a deodorizing function and/or a heat-generating moisture absorption function include woven fabrics, knitted fabrics, clothing, interior products, bedding (e.g., futon covers, sheets, pillow covers, cushion covers, and bed covers), chair covers, and vehicle seat covers that contain the above-described spun yarn. In particular, a fiber product of the present invention is useful, for example, for underwear, T-shirts, socks, gloves, etc. that directly touch the skin when worn, sportswear and the like that are soiled with sweat, and diapers, sanitary products, and the like for which odor can be problematic.

EXAMPLES

Hereinafter, the present invention will be described specifically by way of illustrative examples. It should be noted that the present invention is not limited to the following examples.

Example 1

Processing of Sliver

A sliver for spinning (mass per unit length, unit grain: 21.0 g/6 yd (3.8 g/m)) of regenerated cellulose (cupro: manufactured by Asahi Kasei Corporation, product name "Bemberg" having a single fiber fineness of 1.4 dtex and a fiber length of 38 mm) that had undergone a combing step was removed from a container, and was supplied continuously to an electrocurtain-type electron beam irradiation apparatus EC250/15/180 L (manufactured by IWASAKI ELECTRIC CO., LTD.). In the apparatus, the sliver for spinning was irradiated with an electron beam of 20 kGy under a nitrogen atmosphere. Immediately thereafter, in succession, the sliver irradiated with an electron beam was dipped in a 10 mass % aqueous solution of an acrylic acid (manufactured by NACALAI TESQUE, INC.), and wrung with a mangle such that a pick-up of approximately 100 mass % relative to the weight of the sliver was achieved. As a result, a 10 mass % acrylic acid was provided to the sliver fiber. Then, in succession, the sliver was heat-treated with 100° C. steam for 10 minutes. Then, in succession, the sliver was washed with water in order to remove unreacted acrylic acid, and was oiled with an ordinary spinning oil. Subsequently, the sliver was dried at 80° C., and was coiled and housed in a container. The sliver thus obtained is referred to as "graft cupro". To this graft cupro, 8 mass % of acrylic acid was bonded.

<Blending>

The above-described graft cupro was spun as it was. Further, graft cupro yarns were blended with an unprocessed cotton fiber in the drawing step at the blending ratios below, thereby spinning yarns having a cotton count of 30. For comparison with the following three spun yarns containing the graft cupro, a spun yarn of 100 mass % unprocessed cotton was used.

100 mass % graft cupro 50 mass % graft cupro: 50 mass % cotton 10 mass % graft cupro: 90 mass % cotton <Knitting>

The three spun yarns containing the graft cupro and the spun yarn of 100 mass % unprocessed cotton for comparison were each knitted into a knitted fabric having a single jersey structure using a circular knitting machine (30 inch-28 gage). The knitted fabric obtained from 100 mass % unprocessed cotton is referred to as "Sample 1", the knitted fabric obtained from 100 mass % graft cupro is referred to as "Sample 2", the knitted fabric obtained from 50 mass % graft cupro: 50 mass % unprocessed cotton is referred to as "Sample 3", and the knitted fabric obtained from 10 mass % graft cupro: 90 mass % unprocessed cotton is referred to as "Sample 4".

<Dyeing>

The above-mentioned four plain knitted samples were dyed by the following bleaching step and dyeing step.

<Bleaching Step>

Each of the samples was treated in a liquid mixture of an aqueous solution of sodium hydroxide (manufactured by NACALAI TESQUE, INC.), a 30% hydrogen peroxide solution (manufacture by NACALAI TESQUE, INC) and a stabilizer WC (stabilizing agent) (manufactured by Clariant) in water for 30 minutes at 98° C., and thereafter subjected to hot-water washing and water washing (bath ratio of 1:15). In the liquid mixture, the concentration of sodium hydroxide was 3 g/L, and the concentration of the 30% hydrogen peroxide solution was 5 mL/L, and the concentration of the stabilizer was 1 g/L. Then, each of the samples was treated in a liquid mixture of acetic acid (manufactured by NACALAI TESQUE, INC.) and sodium thiosulfate pentahydrate (manufactured by NACALAI TESQUE, INC.) (3 g/L) in water for 10 minutes at 60° C., and thereafter subjected to hot-water washing and water washing (bath ratio of 1:15). In the liquid mixture, the concentration of acetic acid was 1 mL/L, and the concentration of sodium thiosulfate pentahydrate was 3 g/L.

<Dyeing Step>

A dye solution mixture was prepared by introducing sodium sulfate (manufactured by NACALAI TESQUE, INC) into a dye solution (Sumifix Supra Yellow 3RF 0.7% owf, Sumifix Supra Scarlet 2GF 0.7% owf, Sumifix Supra Blue BRF 0.7% owf (manufactured by Sumitomo Chemical Co., Ltd.)) at 40° C. such that the final concentration was 30 g/L. The samples that had undergone the bleaching step were each treated in the dye solution mixture for 30 minutes at 60° C. Into the dye solution mixture, sodium carbonate (manufactured by NACALAI TESQUE, INC.) was introduced such that the final concentration was 20 g/L. Each of the samples was further treated in the dye solution mixture for 40 minutes at 60° C., and thereafter subjected to hot-water washing and water washing (bath ratio of 1:15). Each of the samples was treated in an aqueous solution (1 g/L) of acetic acid (manufactured by NACALAI TESQUE, INC.) for 10 minutes at 60° C., and then was subjected to water washing and subsequent drying (bath ratio of 1:15).

<Performance Evaluation Method>

1. Samples (1) Sample 1 100 mass % unprocessed cotton (for comparison): knitted fabric weight per square meters, 190 g/m$^2$ (2) Sample 2 100 mass % graft cupro: knitted fabric weight per square meters, 190 g/m$^2$ (3) Sample 3 50 mass % graft cupro: 50 mass % unprocessed cotton: knitted fabric weight per square meters, 190 g/m$^2$ (4) Sample 4 10 mass % graft cupro: 90 mass % unprocessed cotton: knitted fabric weight per square meters, 190 g/m$^2$ Each sample was evaluated for deodorizing performance and heat generating moisture absorption performance in the initial state (0 washes), after 10 washes, after 30 washes, after 50 washes, and after 100 washes. Washing was performed in accordance with the JIS L 0217 103 method.

<Evaluation Items and Methods>

1. Deodorizing Performance (1) Ammonia and Acetic Acid 1 g of each sample that had undergone a predetermined number of washes was placed in a 1 L gas sampling bag, into which various gases (ammonia or acetic acid) having a predetermined concentration were introduced, and the concentrations (ppm) of residual gas after one hour and after two hours were measured with a detecting tube.

(2) Isovaleric Acid

Measurement was carried out at the Japan Spinners Inspecting Foundation in accordance with the instrumental analysis implementation manual (gas chromatography method) prescribed in the deodorizing processed fiber product certification standards of the Japan Textile Evaluation Technology Council.

2. Heat-Generating Moisture Absorption Performance (1) Each sample was cut into a cloth 5 cm long and 5.5 cm wide, and a bag of a size that could completely cover a temperature and humidity sensor was made.

(2) The above-described cloth was dried at 70° C.

(3) A thermo-hygrostat was set such that the temperature was 37° C. and the relative humidity was 90% RH.

(4) The cloths (the cloth for comparison: Sample 1 and the cloths of interest: Samples 2 to 4) each were placed over the temperature and humidity sensor on a silica gel sheet in a re-closable plastic bag, and the humidity was controlled at a humidity of 10% RH or less, and the cloths were left standing until the temperature of the cloth for comparison (the knitted fabric made from an unprocessed fiber) and those of the cloths of interest (the knitted fabrics made from a processed fiber) were approximately the same. In Table 2, Sensor P1 corresponds to the cloth for comparison (the knitted fabric made from the unprocessed fiber), and Sensor P2 corresponds to the cloths of interest (the knitted fabrics made from a processed fiber).

(5) The cloths of the samples described in (4) above were quickly moved into the atmosphere described in (3) above, and the change in temperature over time was recorded every 10 seconds for 10 minutes.

<Evaluation Results>

1. Evaluation Results for Deodorizing Performance

The evaluation results for the deodorizing performance for ammonia and acetic acid are shown in Table 1, and the evaluation results for the deodorizing tests for isovaleric acid are shown in Table 2.

TABLE 1

| Samples | | Ammonia | | | Acetic acid | | |
|---|---|---|---|---|---|---|---|
| | | Initial state Concentration [ppm] | 1 hour later Concentration [ppm] | 2 hours later Concentration [ppm] | Initial state Concentration [ppm] | 1 hour later Concentration [ppm] | 2 hours later Concentration [ppm] |
| Blank test | | 130 | 120 | 123 | 60 | 55 | 47 |
| Sample 1 | 0 washes | — | 60 | 55 | — | 8 | 6 |
| Cotton 100% | 10 washes | — | 75 | 62 | — | 5 | 3 |
| | 30 washes | — | 75 | 62 | — | 5 | 2 |
| | 50 washes | — | 80 | 80 | — | 3 | 2 |

TABLE 1-continued

| Samples | | Ammonia | | | Acetic acid | | |
|---|---|---|---|---|---|---|---|
| | | Initial state Concentration [ppm] | 1 hour later Concentration [ppm] | 2 hours later Concentration [ppm] | Initial state Concentration [ppm] | 1 hour later Concentration [ppm] | 2 hours later Concentration [ppm] |
| | 100 washes | — | 60 | 52 | — | 3 | 3 |
| Sample 2 | 0 washes | — | 10 | 5 | — | 4 | 3 |
| Graft cupro 100% | 10 washes | — | 20 | 13 | — | 3 | 2 |
| | 30 washes | — | 15 | 10 | — | 2 | 1 |
| | 50 washes | — | 25 | 17 | — | 2 | 0.5 |
| | 100 washes | — | 25 | 15 | — | 2 | 1 |
| Sample 3 | 0 washes | — | 5 | 7.5 | — | 3.5 | 2 |
| Graft cupro 50%: | 10 washes | — | 18 | 8 | — | 1.5 | 1 |
| cotton 50% | 30 washes | — | 11 | 9 | — | 1.5 | 1 |
| | 50 washes | — | 17 | 8 | — | 1 | 0.5 |
| | 100 washes | — | 14 | 9 | — | 1 | 0.5 |
| Sample 4 | 0 washes | — | 4 | 3 | — | 2 | 2 |
| Graft cupro 10%: | 10 washes | — | 24 | 15 | — | 2.5 | 1 |
| cotton 90% | 30 washes | — | 19 | 10 | — | 0.5 | 1 |
| | 50 washes | — | 21 | 15 | — | 1 | 1 |
| | 100 washes | — | 20 | 11 | — | 1.5 | 0.5 |

TABLE 2

| Samples | | Reduction rate (%) |
|---|---|---|
| (Sample 2) Graft cupro 100% | Unwashed | 99.9 or more |
| | After 10 washes | 99.9 or more |
| (Sample 3) Graft cupro 50%: | Unwashed | 99.9 or more |
| cotton 50% | After 10 washes | 99.9 or more |
| (Sample 4) Graft cupro 10%: | Unwashed | 99.9 or more |
| cotton 90% | After 10 washes | 99.9 or more |

From Table 1, it was confirmed that, as compared with Sample 1: the cotton 100 mass % article (Comparative Example), Samples 2 to 4 had a clear deodorizing effect for ammonia, with all the samples other than the cotton 100 mass % article, i.e., Samples 2 to 4, exhibiting a deodorization rate of 70% or more one hour later, and 80% or more two hours later. On the other hand, it was confirmed that for acetic acid, Sample 1: the cotton 100 mass % article (Comparative Example) also exhibited a deodorization rate of 80% or more one hour later, with all of Samples 1 to 4, including the cotton 100% article, exhibiting a deodorization rate of 90% or more two hours later. Furthermore, from Table 2, it was confirmed that Samples 2 to 4 exhibited a deodorizing effect also for isovaleric acid. More specifically, even Sample 4, which was the sample with 10% graft cupro, was confirmed to have a sufficient deodorizing effect.

2. Evaluation Results for Heat-Generating Moisture Absorption Performance

The results are shown in Table 3.

TABLE 3

| No. | Sensor P1 (Number of washes) | | Sensor P2 (Number of washes) | | Maximum temperature difference [° C.] |
|---|---|---|---|---|---|
| 1 | Sample 1 | 0 | Sample 2 | 0 | 1.9 (P1 < P2) |
| 2 | Sample 1 | 10 | Sample 2 | 10 | 2.3 (P1 < P2) |
| 3 | Sample 1 | 30 | Sample 2 | 30 | 1.9 (P1 < P2) |
| 4 | Sample 1 | 50 | Sample 2 | 50 | 1.8 (P1 < P2) |
| 5 | Sample 1 | 100 | Sample 2 | 100 | 2.2 (P1 < P2) |
| 6 | Sample 1 | 0 | Sample 3 | 0 | 1.7 (P1 < P2) |
| 7 | Sample 1 | 10 | Sample 3 | 10 | 1.8 (P1 < P2) |
| 8 | Sample 1 | 30 | Sample 3 | 30 | 1.8 (P1 < P2) |
| 9 | Sample 1 | 50 | Sample 3 | 50 | 2.4 (P1 < P2) |
| 10 | Sample 1 | 100 | Sample 3 | 100 | 1.7 (P1 < P2) |
| 11 | Sample 1 | 0 | Sample 4 | 0 | 0.5 (P1 < P2) |

TABLE 3-continued

| No. | Sensor P1 (Number of washes) | | Sensor P2 (Number of washes) | | Maximum temperature difference [° C.] |
|---|---|---|---|---|---|
| 12 | Sample 1 | 10 | Sample 4 | 10 | 0.7 (P1 < P2) |
| 13 | Sample 1 | 30 | Sample 4 | 30 | 1.1 (P1 < P2) |
| 14 | Sample 1 | 50 | Sample 4 | 50 | 0.5 (P1 < P2) |
| 15 | Sample 1 | 100 | Sample 4 | 100 | 0.7 (P1 < P2) |

Figure 2:
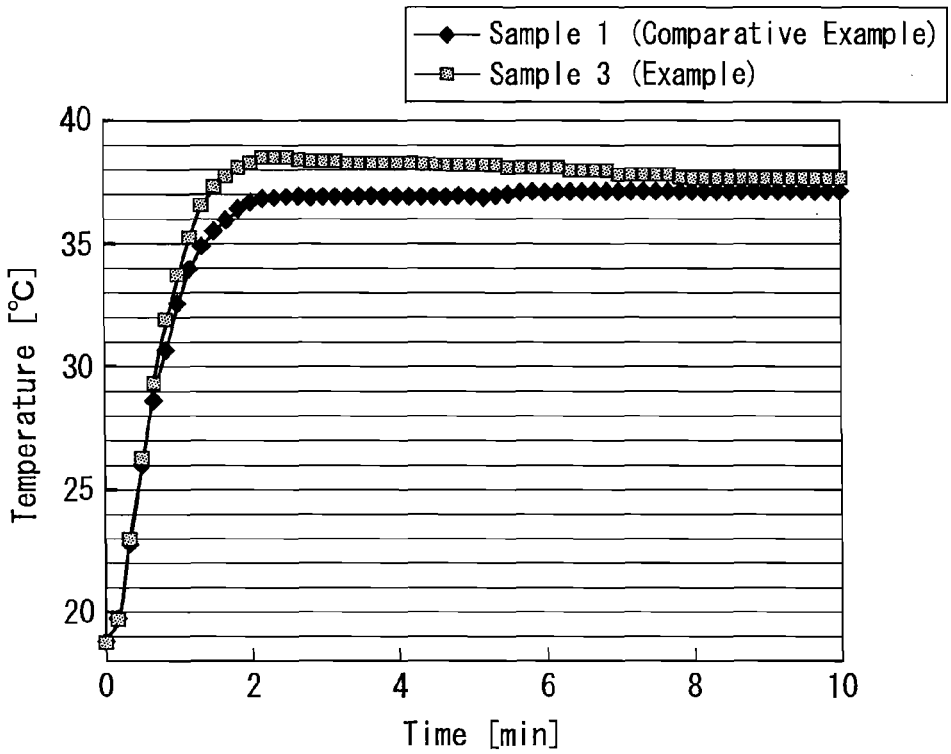
FIG. 2 is a graph showing the heat-generating moisture absorption properties of a fabric according to another example of the present invention.
Figure 3:
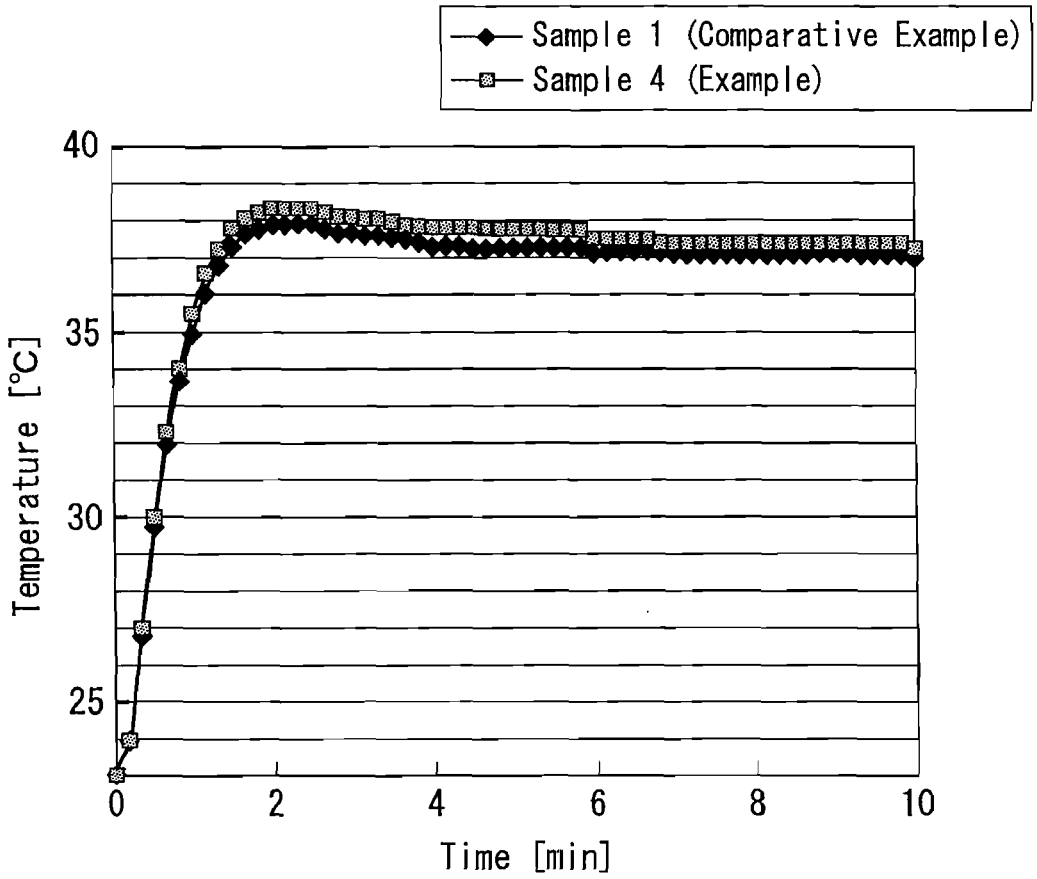
FIG. 3 is a graph showing the heat-generating moisture absorption properties of a fabric according to yet another example of the present invention.

From Table 3, it was confirmed that Samples 2 to 4 had higher heat-generating moisture absorption properties, to a greater or lesser extent, than Sample 1: the cotton 100 mass % article (Comparative Example). FIG. 1 shows a graph of the heat-generating moisture absorption properties of the two samples in row No. 1 of Table 3, FIG. 2 shows a graph of the heat-generating moisture absorption properties of the two samples in row No. 6 of Table 3, and FIG. 3 shows a graph of the heat-generating moisture absorption properties of the two samples in row No. 11 of Table 3.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

The invention claimed is:

1. A continuous sliver for spinning having a deodorizing function and/or a heat-generating moisture absorption function, wherein a continuous sliver having a thickness of 3.2 g/6 yd to 97.2 g/6 yd and formed as a continuous bundle in which staple fibers are aligned in one direction is irradiated with an electron beam so that at least one material selected from the group consisting of an activating group and a radical is present on a surface of the fibers, a compound including an ethylenic unsaturated double bond is chemically bonded to the surface of the fibers, and a resulting continuous sliver for spinning has at least one function selected from the group consisting of a deodorizing function and a heat-generating moisture absorption function.

2. The continuous sliver for spinning according to claim 1, wherein the continuous sliver for spinning is a sliver ranging from a carded sliver to a drawn sliver.

3. The continuous sliver for spinning according to claim 1, wherein the compound including an ethylenic unsaturated double bond is at least one carboxylic acid selected from the group consisting of acrylic acid, methacrylic acid, itaconic acid, maleic acid and fumaric acid, or an ester or a salt thereof.

4. The continuous sliver for spinning according to claim 1, wherein the compound including an ethylenic unsaturated double bond is provided to the staple fibers in the range of 1 to 30 mass %.

5. The continuous sliver for spinning according to claim 1, wherein the staple fibers are at least one fiber selected from the group consisting of cotton, regenerated cellulose, cellulose acetate, ramie, kenaf, wool, silk, nylon, acrylic fiber, polylactic fiber, acetate fiber and ethylene vinyl alcohol.

6. A method for producing a continuous sliver for spinning having a deodorizing function and/or a heat-generating moisture absorption function, comprising:

irradiating a continuous sliver for spinning formed as a continuous bundle in which staple fibers are aligned in one direction, with an electron beam under a nitrogen atmosphere so that at least one material selected from the group consisting of an activating group and a radical is produced on a surface of the fibers, wherein the continuous sliver for spinning has a thickness of 3.2 g/6 yd to 97.2 g/6 yd, and immediately thereafter, continuously bringing a compound including an ethylenic unsaturated double bond into contact with the surface of the fibers so that the compound is bound to the surface of the fibers with a chemical bond, thereby imparting the continuous sliver for spinning with at least one function selected form the group consisting of a deodorizing function and a heat-generating moisture absorption function.

7. The method according to claim 6, wherein the continuous sliver for spinning is a sliver ranging from a carded sliver to a drawn sliver.

8. The method according to claim 6, wherein the compound including an ethylenic unsaturated double bond is at least one carboxylic acid selected from the group consisting of acrylic acid, methacrylic acid, itaconic acid, maleic acid and fumaric acid, or an ester or a salt thereof.

9. The method according to claim 6, wherein the compound including an ethylenic unsaturated double bond is provided to the staple fibers in the range of 1 to 30 mass %.

10. The method according to claim 6, wherein the staple fibers are at least one fiber selected from the group consisting of cotton, regenerated cellulose, cellulose acetate, ramie, kenaf, wool, silk, nylon, acrylic fiber, polylactic fiber, acetate fiber and ethylene vinyl alcohol.

11. A spun yarn having a deodorizing function and/or a heat-generating moisture absorption function, comprising the continuous sliver for spinning according to claim 1 and a sliver other than the sliver for spinning that have been blended together and spun.

12. A fiber product having a deodorizing function and/or a heat-generating moisture absorption function, comprising the spun yarn according to claim 11.

* * * * *